US007498746B2

(12) United States Patent
Kweon et al.

(10) Patent No.: US 7,498,746 B2
(45) Date of Patent: Mar. 3, 2009

(54) PLASMA DISPLAY PANEL (PDP)

(75) Inventors: Tae-Joung Kweon, Suwon-si (KR); Kyoung-Doo Kang, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 218 days.

(21) Appl. No.: 11/342,682

(22) Filed: Jan. 31, 2006

(65) Prior Publication Data

US 2006/0170355 A1 Aug. 3, 2006

(30) Foreign Application Priority Data

Feb. 3, 2005 (KR) ..... 10-2005-0010244

(51) Int. Cl.
*H01J 17/49* (2006.01)

(52) U.S. Cl. ..... 313/586; 313/582

(58) Field of Classification Search ..... 313/582–587
See application file for complete search history.

(56) References Cited

U.S. PATENT DOCUMENTS 5,541,618 A 7/1996 Shinoda
5,661,500 A 8/1997 Shinoda et al.
5,663,741 A 9/1997 Kanazawa
5,674,553 A 10/1997 Shinoda et al.
5,701,056 A * 12/1997 Shinohara ..... 313/584
5,724,054 A 3/1998 Shinoda
5,744,909 A * 4/1998 Amano ..... 313/585
5,786,794 A 7/1998 Kishi et al.
5,952,782 A 9/1999 Nanto
6,242,859 B1 * 6/2001 Betsui et al. ..... 313/584
RE37,444 E 11/2001 Kanazawa (Continued)

FOREIGN PATENT DOCUMENTS

JP 08-045433 2/1996

(Continued)

OTHER PUBLICATIONS

*Final Draft International Standard*, Project No. 47C/61988-1/Ed.1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

(Continued)

*Primary Examiner*—Peter Macchiarolo
(74) *Attorney, Agent, or Firm*—Robert E. Bushnell, Esq.

(57) ABSTRACT

A Plasma Display Panel (PDP) which enables low-voltage address discharge, enhances maintenance of an address voltage and prevents an abnormal discharge in the outside of a display available area, includes: a front substrate; a rear substrate disposed parallel to the front substrate; a plurality of barrier ribs interposed between the front substrate and the rear substrate to define discharge cells together with the front and rear substrates; a plurality of electrodes enclosing each of the discharge cells; a fluorescent layer arranged in each of the discharge cells; and a discharge gas in the discharge cells. A portion of an outermost barrier rib defining an outside edge of an outermost discharge cell is thicker than a remaining portion of the outermost barrier rib.

17 Claims, 5 Drawing Sheets

U.S. PATENT DOCUMENTS

| | | | | |
|---|---|---|---|---|
| 6,456,007 | B1 * | 9/2002 | Ryu et al. | 313/586 |
| 6,630,916 | B1 | 10/2003 | Shinoda | |
| 6,707,436 | B2 | 3/2004 | Setoguchi et al. | |
| 6,884,142 | B2 * | 4/2005 | Kang et al. | 313/586 |
| 2001/0008825 | A1 * | 7/2001 | Toyoda et al. | 313/584 |
| 2002/0003406 | A1 * | 1/2002 | Kang et al. | 313/587 |
| 2002/0033669 | A1 * | 3/2002 | Kanazawa et al. | 313/582 |
| 2004/0075389 | A1 * | 4/2004 | Kim et al. | 313/587 |
| 2005/0236986 | A1 * | 10/2005 | Kwon et al. | 313/582 |

FOREIGN PATENT DOCUMENTS

| | | |
|---|---|---|
| JP | 2845183 | 10/1998 |
| JP | 2917279 | 4/1999 |
| JP | 2000-133144 | 5/2000 |
| JP | 2001-035381 | 2/2001 |
| JP | 2001-043804 | 2/2001 |
| JP | 2001-155648 | 6/2001 |
| JP | 2001-312972 | 11/2001 |
| JP | 2001-325888 | 11/2001 |
| KR | 10-2004-0018010 | 3/2004 |

OTHER PUBLICATIONS

Office action from the Japanese Patent Office issued in Applicant's corresponding Japanese Patent Application No. 2006-023871 dated Nov. 11, 2008.

* cited by examiner

PLASMA DISPLAY PANEL (PDP)

CLAIM OF PRIORITY

This application makes reference to, incorporates the same herein, and claims all benefits accruing under 35 U.S.C. § 119 from an application for PLASMA DISPLAY PANEL AND FLAT DISPLAY DEVICE COMPRISING THE SAME earlier filed in the Korean Intellectual Property Office on 3 Feb. 2005 and there duly assigned Serial No. 10-2005-0010244.

BACKGROUND OF THE INVENTION

1. Field of the Invention

The present invention relates to a Plasma Display Panel (PDP), and more particularly, to a PDP which can obtain a strong electric field effect during an address discharge and prevent an abnormal discharge in a non-display area.

2. Description of the Related Art

A plasma display is a flat panel display including a PDP and is expected to be a next generation large flat panel display due to its large screen size and excellent characteristics, such as high resolution, extreme thinness and lightness, and large viewing angle. Furthermore, the method of manufacturing the plasma display is simpler than the method of manufacturing other flat panel display panels, and it is easy to increase the size of the plasma display.

PDPs are classified into Direct Current (DC) PDPs, Alternating Current (AC)PDPs, and hybrid PDPs according to a supplied discharge voltage, and into opposite discharge PDPs and surface discharge PDPs according to their discharge structure.

In a DC PDP, all electrodes are exposed to a discharge space, and charges move directly between corresponding electrodes. In an AC PDP, at least one electrode is covered by a dielectric layer and a discharge occurs due to the effect of an electric field on wall charges, instead of charges directly moving between corresponding electrodes.

Since the electrodes in the DC PDP can be seriously damaged because the charges directly move between the corresponding electrodes, the AC PDP has recently been used more often.

In an AC PDP, address electrodes, X electrodes, and Y electrodes are arranged around a discharge space between a front substrate and a rear substrate and partitioned by barrier ribs. When a discharge occurs, an address discharge initially occurs between the address electrode and the X electrode or the Y electrode, and subsequently, a sustain discharge occurs between the X electrode and the Y electrode.

However, in the AC PDP, a long discharge path between the address electrode and the X electrode or the Y electrode during the address discharge results in a high address discharge voltage, and it is difficult to maintain the address voltage.

SUMMARY OF THE INVENTION

The present invention provides a Plasma Display Panel (PDP), which enables a low-voltage address discharge and enhances maintenance of an address voltage.

The present invention also provides a PDP capable of preventing an abnormal discharge outside of a display available area.

According to one aspect of the present invention, a Plasma Display Panel (PDP) is provided including: a front substrate; a rear substrate disposed parallel to the front substrate; a plurality of barrier ribs interposed between the front substrate and the rear substrate to define discharge cells together with the front and rear substrates; a plurality of electrodes enclosing each of the discharge cells; a fluorescent layer arranged in each of the discharge cells; and a discharge gas in the discharge cells; a portion of an outermost barrier rib defining an outside edge of an outermost discharge cell is thicker than a remaining portion of the outermost barrier rib.

According to another aspect of the present invention, a Plasma Display Panel (PDP) is provided including: a front substrate; a rear substrate disposed parallel to the front substrate; a plurality of barrier ribs interposed between the front substrate and the rear substrate to define discharge cells together with the front and rear substrates, and including a dielectric; a plurality of electrodes enclosing each of the discharge cells; a fluorescent layer arranged in each of the discharge cells; and a discharge gas in the discharge cells; a dielectric permittivity of a portion of the outermost barrier rib defining an outside edge of an outermost discharge cell is smaller than a dielectric permittivity of a remaining portion of the outermost barrier rib.

According to still another aspect of the present invention, a Plasma Display Panel (PDP) is provided including: a front substrate; a rear substrate disposed parallel to the front substrate; a plurality of barrier ribs interposed between the front substrate and the rear substrate to define discharge cells together with the front and rear substrates, and including a dielectric; a plurality of electrodes enclosing each of the discharge cells; a fluorescent layer formed in each of the discharge cells; and a discharge gas in the discharge cells; a dummy barrier rib is formed outside of an outermost barrier rib defining an outside edge of an outermost discharge cell.

BRIEF DESCRIPTION OF THE DRAWINGS

A more complete appreciation of the present invention and many of the attendant advantages thereof, will be readily apparent as the present invention becomes better understood by reference to the following detailed description when considered in conjunction with the accompanying drawings in which like reference symbols indicate the same or similar components, wherein.

DETAILED DESCRIPTION OF THE INVENTION

The present invention will now be described more fully with reference to the accompanying drawings, in which exemplary embodiments of the present invention are shown. The present invention can, however, be embodied in many different forms and should not be construed as being limited to the embodiments set forth herein. Rather, these embodiments are provided so that this disclosure will be thorough and complete, and will fully convey the concept of the present invention to those skilled in the art.

Figure 1:
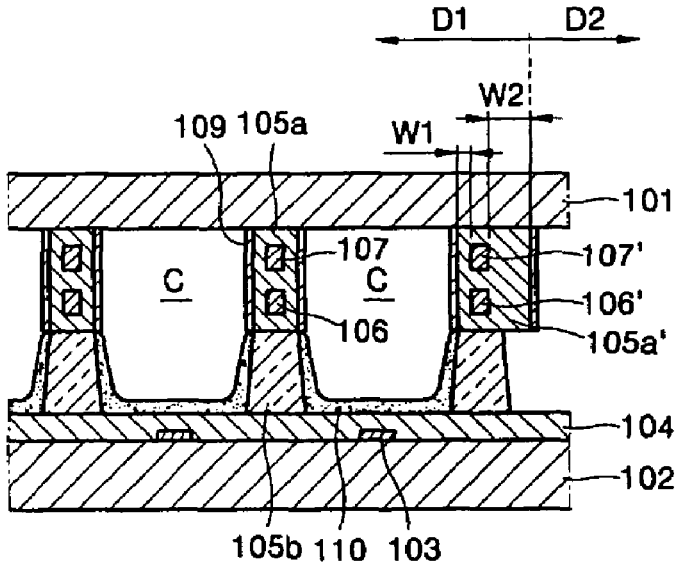
FIG. 1 is a cross-sectional view of a PDP according to an embodiment of the present invention.
Figure 2:
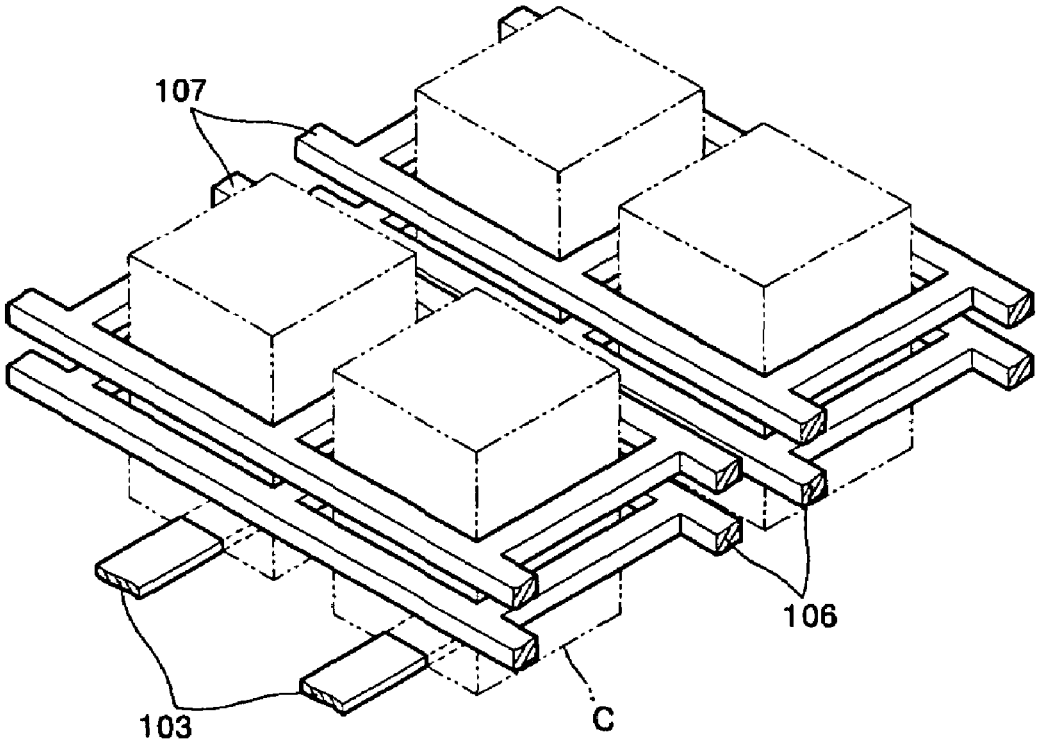
FIG. 2 is a perspective view of an electrode structure of the PDP of FIG. 1.

FIG. 1 is a cross-sectional view of a PDP 100 according to an embodiment of the present invention, and FIG. 2 is a perspective view for schematically explaining an electrode structure of the PDP 100.

Referring to FIG. 1, the PDP 100 includes a front substrate 101, a rear substrate 102 arranged opposite to the front substrate 101, and first barrier ribs 105*a* and second barrier ribs 105*b* which are formed between the front substrate 101 and the rear substrate 102 to maintain a discharge distance between the first and rear substrates 101 and 102 and to prevent electrical cross-talk between pixels. Discharge cells C are defined by the front substrate 101, the rear substrate 102, and barrier ribs 105*a* and 105*b*. The discharge cells C are filled with a discharge gas, and edges of the front and rear substrates 101 and 102 are sealed by a sealing member (not shown) such as frit glass.

Address electrodes 103 are arranged in a predetermined pattern, and a first dielectric layer 104 covers the address electrodes 103. The second barrier ribs 105*b* are formed on the first dielectric layer 104. The second barrier ribs 105*b* can be open barrier ribs with a stripe pattern in which the barrier ribs extend parallel to the address electrodes 103, or can be closed barrier ribs with waffle, matrix, or delta patterns. Furthermore, the closed barrier ribs can be formed such that a cross-section of the barrier rib is polygonal shaped, such as triangular, rectangular, or pentagonal, round shaped, or oval.

The first barrier ribs 105*a* are formed on the front substrate 101. As described above, the first barrier ribs 105*a* and the second barrier ribs 105*b* define the discharge cells C.

Discharge electrodes, for example, X electrodes 107 and Y electrodes 106, are formed on the first barrier ribs 105*a* such that the discharge electrodes 107 and 106 respectively enclose the discharge cell C. The X electrodes 107 and the Y electrodes 106 are arranged such that a discharge occurs in a continuous plan due to a voltage between the X electrodes 107 and the Y electrodes 106. In the present embodiment, although the X electrode 107 and the Y electrode 106 are formed on the first barrier ribs 105*a*, the X and Y electrodes 107 and 106 can be formed in various forms and at various positions as long as the X and Y electrodes 107 and 106 generates a surface discharge inside the discharge cells C. For example, each of the X electrode s107 and the Y electrodes 106 can be formed in a ring shape parallel to each other on the first barrier ribs 105*b* such that the X and Y electrodes 107 and 106 enclose the discharge cell C. The distance between the X electrodes 107 and the Y electrodes 106 is acceptable if the surface discharge can occur between the X electrodes 107 and the Y electrodes 106, but minimizing the distance between the X and Y electrodes 107 and 106 is desirable because this minimizes a discharge voltage.

A protection film 109 made of, for example, MgO can be formed on a surface of the first barrier ribs 105*a* to protect them.

A fluorescent layer 110 of a fluorescent substance which is excited by ultraviolet rays emitted from the discharge gas to emit visible rays is formed in the discharge cell C. The fluorescent layer 110 can be formed in any region of the discharge cell C, but in the present embodiment is formed on both sides of the second barrier ribs 105*b* and the first dielectric layer 104 as shown in FIG. 1 considering the transmission of visible light. To display a full-color image, the fluorescent layer 110 includes red, green, and blue regions, and each of the discharge cells C is coated with one of the red, green, and blue regions.

Each of the discharge cells C is injected with a discharge gas such as Ne, Xe, or a mixed gas composed of Ne and Xe. In this embodiment of the present invention, since the discharging surface can be enlarged and the discharge region can be expanded to increase the amount of plasma formed, low-voltage driving is possible. Accordingly, low-voltage driving is possible even when a hyperbaric Xe gas is used as a discharge gas, and hence luminous efficiency is remarkably improved. Therefore, the problem that low-voltage driving is difficult when the hyperbaric Xe gas is used as a discharge gas in the conventional PDP is resolved.

Furthermore, the front substrate 101 does not include discharge electrodes and bus electrodes formed of Indium Tin Oxide (ITO) or a dielectric layer covering the discharge electrode and bus electrodes which are formed on a front substrate of the conventional PDP. Therefore, in embodiments of the present invention, the aperture ratio of the front substrate 101 can be substantially improved and the transmission of visible rays can be increased to 90 percent, which enables the low-voltage driving, and a high luminous efficiency. The front substrate 101 can be made of any transparent material, for example, glass.

A detailed description of a discharge occurring in the PDP 100 of the present embodiment is described below.

When a predetermined address voltage is supplied between the address electrodes 103 and Y electrodes 106 from an external power supply, an address discharge occurs. One of the discharge cells C which will emit light is selected by the address discharge, and wall charges are accumulated on the Y electrode 106 of the selected discharge cell C. Next, when a positive (+) voltage is supplied to the X electrode 107 and a voltage lower than the positive (+) voltage is supplied to the Y electrode 106, the wall charges move due to a difference in the voltages supplied between the X and Y electrodes 107 and 106. The wall charges produce a plasma by generating a discharge while colliding with atoms of the discharge gas inside the discharge cell C. Such a discharge is most likely to occur in an area where the distance between the X electrode 107 and the Y electrode 106 is at a minimum and a relatively strong electric field is formed. In the present embodiment, since the X electrode 107 is closest to the Y electrode 106 along the side of the discharge cell C, the probability of a discharge occurring is higher than in the conventional PDP in which an area where the discharge electrodes are close to each other is formed on only a top surface of a discharge space. When the voltage difference between the X and Y electrodes 107 and 106 is kept sufficiently large, the electric field formed between the opposite surfaces of the X and Y electrodes 107 and 106 increases over time, and thus, the discharge spreads over the entire discharge cell C. In the present embodiment, since the discharge is formed by the X and Y electrodes 107 and 106 in a ring shape on four sides of the discharge cell C (when the barrier ribs 105*a* are arranged, for example, in a matrix pattern) and spread from the four sides to the center of the discharge cell C, the spreading range of the discharge is greatly increased. Furthermore, in the present embodiment, a plasma produced by the discharge is formed in a ring shape along the side of the discharge cell C and spread to the center of the discharge cell C, and thus, the volume of plasma is increased and the amount of visible light produced is also increased. Space charges can be used since the plasma is concentrated in the center of the discharge cell C, thereby enabling low-voltage driving and improving luminous efficiency. Moreover, since the plasma is concentrated in the center of the discharge cell C and the electric field due to the discharge electrodes 106 and 107 is formed on both sides of the plasma, the charges are concentrated in the center of the discharge cell C, thereby preventing ion sputtering damage to the fluorescent layer 110.

When the voltage difference between the X electrode 107 and the Y electrode 106 is lower than the discharge voltage after the discharge occurs, the discharge no longer occurs and space charges and wall charges form in the discharge cell C. When the polarities of the respective voltages supplied to the X electrode and the Y electrode are inverted, the discharge occurs again with the help of the wall charges. Thereafter, in a similar way as described above, the discharge is spread over the entire discharge cell C and then dissipated.

Then, if the polarities of the respective voltage supplied to the X and Y electrodes 107 and 106 are inverted again, the above discharge processes are repeated. By repeating these processes, the discharge stably occurs.

However, the discharge processes are not limited to the above, and such a discharge can occur in various ways in the field to which the present invention pertains without departing from the scope of the present invention. For example, in FIGS. 1 and 2, the address electrodes 103 can be excluded from the electrode structure and the X electrodes 107 and the Y electrodes 106 can extend perpendicular to each other, so that the X electrodes or the Y electrodes also act as address electrodes.

Referring to FIG. 1, there is a dummy area D2 outside of a display area D1 on which an image is displayed.

An abnormal discharge can occur in the dummy area D2 between an X electrode 107' and a Y electrode 106' which are buried in the outermost first barrier rib 105*a'*.

To prevent the abnormal discharge, the thickness of the outermost first barrier rib 105*a'* close to the dummy area D2 is formed thicker than the other first barrier ribs 105*b* in the present embodiment.

More specifically, the thickness W2 of the discharge first barrier rib 105*a'* between the X and Y electrodes 107' and 106' and the dummy area D2 is greater than the thickness W1 between the X and Y electrodes 107' and 106' and the outermost discharge cell C'.

The amount of charge accumulated to generate a discharge on the surface of a barrier rib is denoted by:

$$Q=VC \tag{1}$$

where Q is the amount of charge, C is capacitance, and V is applied voltage.

In Equation 1, C is obtained from:

$$C=\epsilon S/d \tag{2}$$

Where '$\epsilon$' is dielectric permittivity, 'S' is area, and 'd' is distance.

In Equation 2, since the dielectric permittivity $\epsilon$ is predetermined and the area S of each of the electrodes is the same in the outermost first barrier rib 105*a'*, an electric field is decreased if the distance 'd' is increased, and thus a value of 'C' is reduced.

Since the thickness W2 of the outermost first barrier rib 105*a'* between the X and Y electrodes 107' and 106' and the dummy area D2 is greater than the thickness W1 between the X and Y electrodes 107' and 106' and the discharge area D1, C can be reduced. Since the C is small, a sufficient charge for generating a discharge can accumulate on the first barrier rib 105*a'* only when the supplied voltage is high enough according to Equation 1. Therefore, when a proper voltage for driving the display area D1 is supplied to the outermost first barrier rib 105*a'*, charges cannot accumulate near the dummy area D2 where a dielectric is thick, and thus the discharge cannot occur.

Since a voltage margin generally tends to decrease by between 2 and 3 V when the distance decreases by 1 μm, if W2 is 10 μm greater than W1, the abnormal discharge in the dummy area D2 can be effectively prevented even when the PDP 100 has a voltage margin of 30 V.

The above effects are not only obtained by increasing the thickness of the dielectric adjacent to the dummy area D2.

Figure 3:
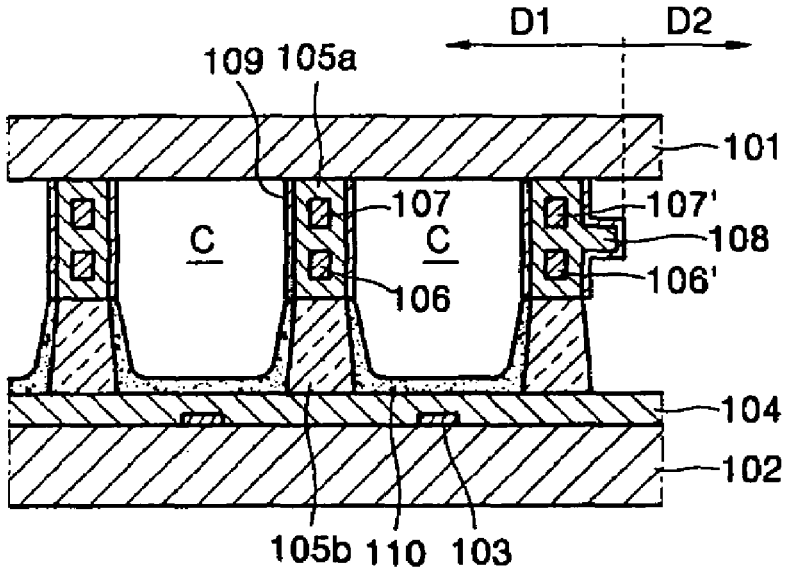
FIG. 3 is a cross-sectional view of the PDP, including a protruding portion, according to another embodiment of the present invention.

Specifically, as shown in FIG. 3, a protruding portion 108 is formed between the X electrode 107' and the Y electrode 106' of the outermost first barrier rib 105*a'*, causing the portion between the X electrode 107' and the Y electrode 106' to be thicker than other potion of the outermost first barrier rib 105*a'*, and thus the effects described above can be obtained. In this case, the electric field generated between the X electrode 107' and the Y electrode 106' is weakened in the same way as described above, which prevents a discharge, and consequently the abnormal discharge can be prevented.

The protruding portion 108 shown in FIG. 3 can be made of a material having the same dielectric permittivity as the first barrier rib 105*a*, but is not limited thereto. Furthermore, when the protruding portion 108 is made of a material having a lower dielectric permittivity than the first barrier rib 105*a*, the value of C of Equation 2 is reduced, and thus the abnormal discharge can be more effectively prevented.

Figure 4:
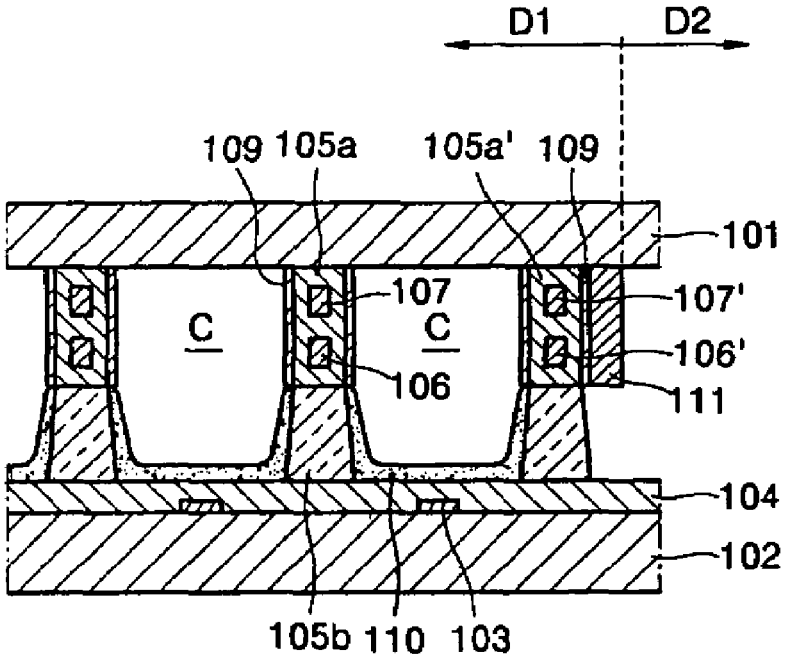
FIG. 4 is a cross-sectional view of the PDP employing a supplementary dielectric, according to another embodiment of the present invention.

FIG. 4 is a cross-sectional view of another embodiment employing a supplementary dielectric 111. Referring to FIG. 4, the outermost first barrier rib 105*a'* is formed to be the same as the other first barrier ribs 105*a*, and the supplementary dielectric 111 is formed on the side of the outermost first barrier rib 105*a'* toward the dummy area D2 such that a portion facing the dummy area D2 is thick.

The supplementary dielectric 111 can be made of a material having a lower dielectric permittivity than the dielectric forming the first barrier ribs 105*a*. Consequently, the value of C of Equation 2 is more reduced as described above, and thus the abnormal discharge can be more effectively prevented.

Figure 5:
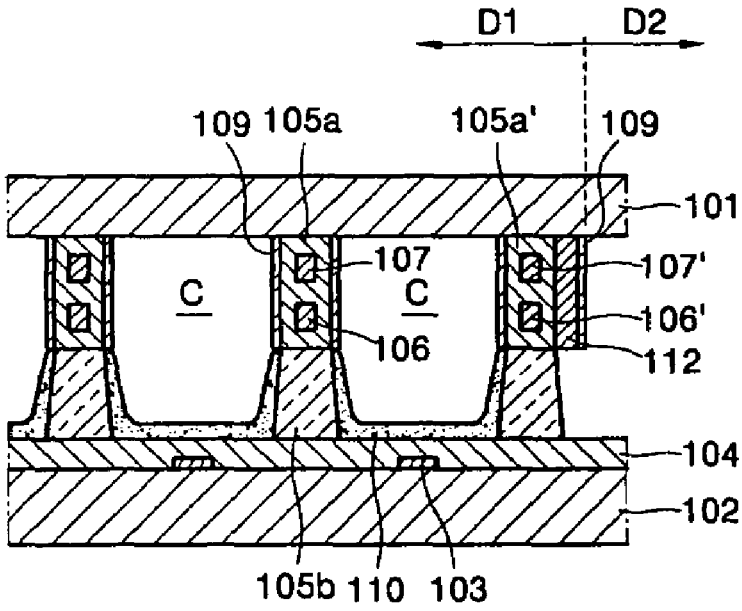
FIG. 5 is a cross-sectional view of the PDP when a portion of the sustain discharge first barrier rib facing the dummy barrier rib is made of a material having a lower dielectric permittivity than the rest of the sustain discharge first barrier rib.

FIG. 5 is a cross-sectional view of another embodiment when a portion of the outermost first barrier rib 105*a'* facing the dummy are D2 is made of a material having a lower dielectric permittivity that the rest of the outermost first barrier rib 105*a'*. Referring to FIG. 5, the total thickness of the outermost first barrier rib 105*a'* is the same as the outer first barrier rib 105*a*, but a portion 112 facing the dummy area D2 can be made of a material having a lower dielectric permittivity than the rest of the outermost first barrier rib 105*a'*.

In this case, since $\epsilon$ decreases and d is not changed, the value of C is reduced, the discharge is suppressed, which allows the abnormal discharge to be more effectively prevented.

Figure 6:
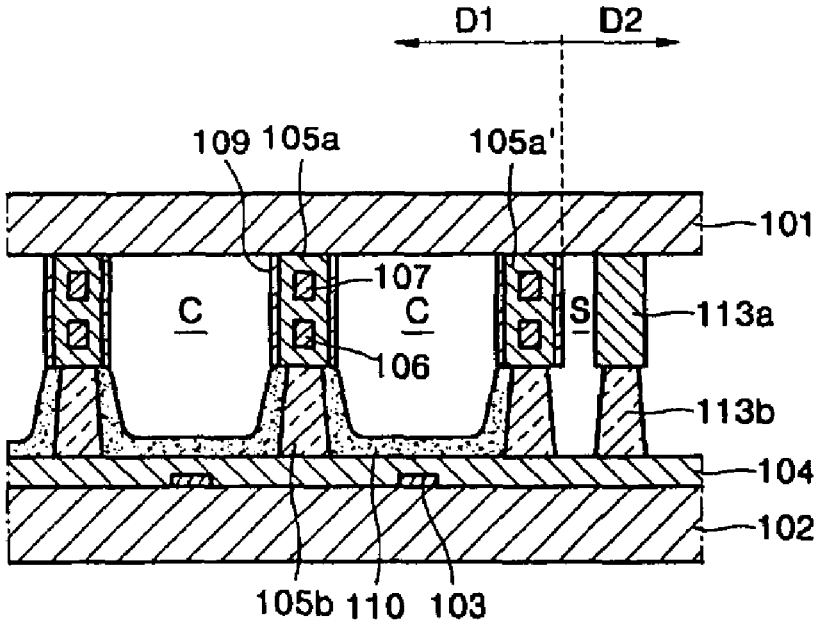
FIG. 6 is a cross-sectional view of the PDP including dummy barrier ribs.

FIG. 6 is a cross-sectional view of another embodiment including dummy barrier ribs 113*a* and 113*b*. Referring to FIG. 6, dummy barrier ribs 113*a* and 113*b* are formed outside of the outermost first barrier rib 105*a'*, that is, in the dummy area D2. The dummy barrier ribs 113*a* and 113*b* may include a first dummy barrier rib 113*a* and a second dummy barrier rib 113*b* respectively corresponding to the first and second barrier ribs 105*a* and 105*b* that define the discharge cells C.

A space S between the first dummy barrier rib 113*a* and the outermost first barrier rib 105*a'* adjacent to the first dummy barrier rib 113*a* is narrower than each of the discharge cells C, and therefore it is difficult for a discharge to occur in this space S.

Generally, to generate a discharge, sufficient wall charges must be accumulated on the dielectric and the discharge space must be sufficiently large for accumulated wall charges to dissipate so that the discharge occurs. When the discharge space is too small, the conditions for generating a discharge are not ideal, and a driving voltage for generating the discharge is increased. Hence, when an appropriate voltage is supplied to generate the discharge in the display area D1, the discharge does not occur in the space S, and the abnormal discharge can be prevented in the dummy area D2.

The effects as described above can be obtained using other structures than the above electrode and barrier rib structure.

Figure 7:
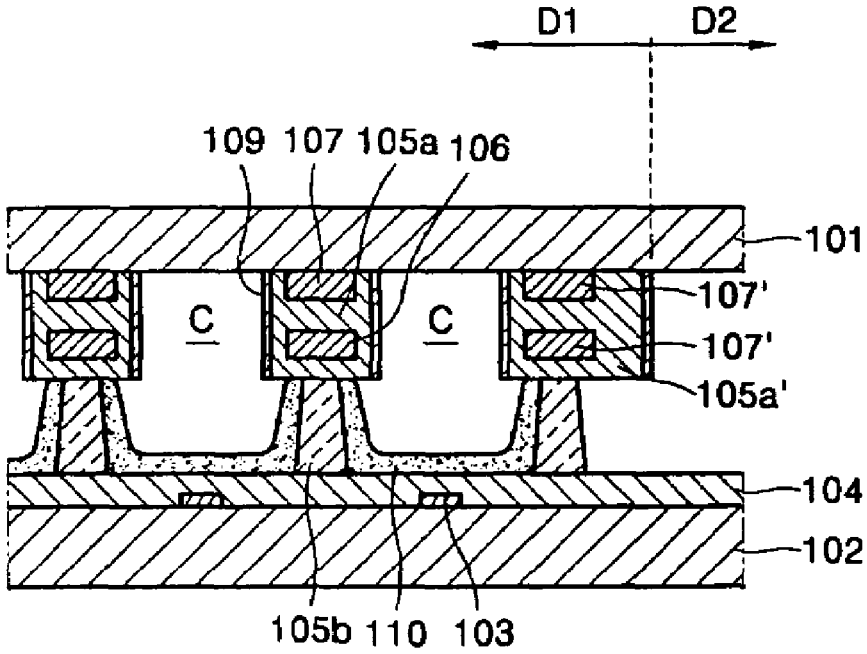
FIG. 7 is a cross-sectional view of a PDP according to another embodiment of the present invention.

FIG. 7 is a cross-sectional view of a PDP according to another embodiment of the present invention. Referring to FIG. 7, the first barrier ribs 105*a* can be cylindrical instead of rectangular, and the X electrode 107 formed on the front substrate 101 and the Y electrode 106 parallel to the X electrode 107 have rectangular cross-sectional extending widthwise in each of the first barrier ribs 105*a*. Except of the above, the structure of the PDP of FIG. 7 is the same as the PDP of FIG. 1. The PDP with this structure more effectively enables the concentration of plasma. The structures of FIG. 3 through FIG. 6 can be applied to present embodiment.

Figure 8:
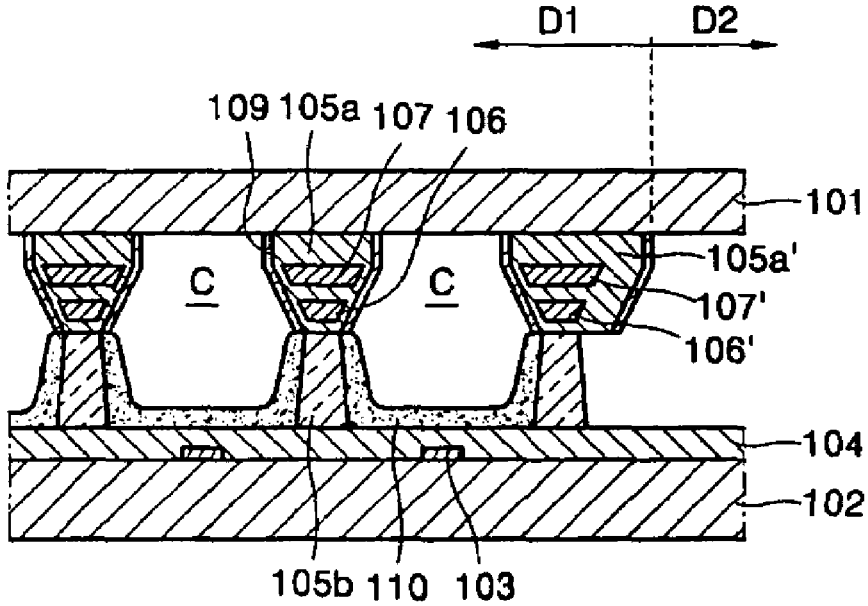
FIG. 8 is a cross-sectional view of a PDP according to another embodiment of the present invention.

FIG. 8 is a cross-sectional view of a PDP according to another embodiment of the present invention. Referring to FIG. 8, the PDP of FIG. 8 is almost the same as the PDP of FIG. 7, except the discharge surface of the first barrier rib 105*a* is not perpendicular but diagonal to the front substrate 101. This structure enables the concentration of plasma and diffusion of plasma to the center of the discharge cell C more effectively. The structures of FIG. 3 through FIG. 6 can be applied to the present embodiment.

Figure 9:
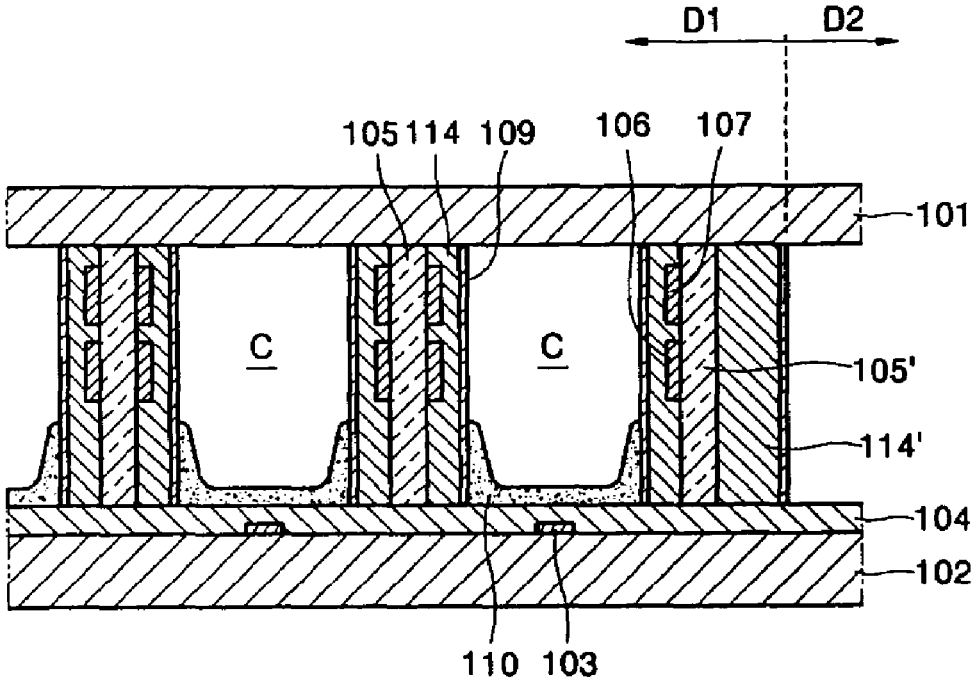
FIG. 9 is a cross-sectional view of a PDP according to another embodiment of the present invention.

FIG. 9 is a cross-sectional view of a PDP according to another embodiment of the present invention. Referring to FIG. 9, the discharge cells C are defined by integrally formed barrier ribs 105. The X and Y electrodes 107 and 106 are formed on both sides of each of the barrier ribs 105, and a dielectric layer 114 is formed to cover the X and Y electrodes 107 and 106. In this case, the outermost dielectric layer 114' is formed on the outer side of the outermost barrier rib 105' to be thicker than the other dielectric layers 114 so that the abnormal discharge in the outside of the display area D1 can be prevented. The structures of FIG. 3 through FIG. 6 can be applied to the present embodiment.

Figure 10:
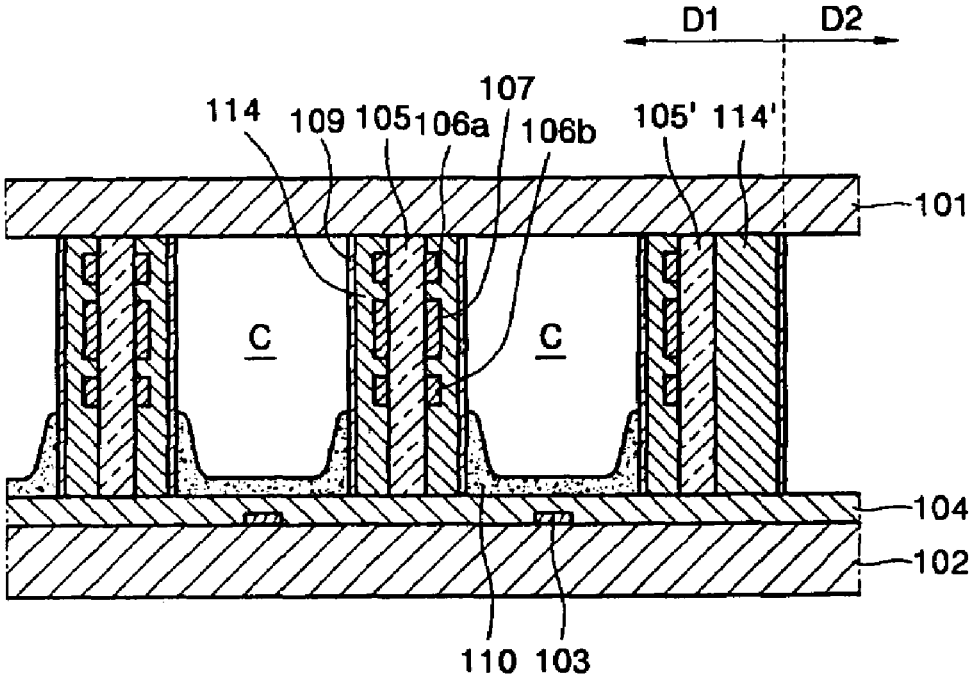
FIG. 10 is a cross-sectional view of the PDP of FIG. 9 having a modified electrode structure.

FIG. 10 is a cross-sectional view of the PDP of FIG. 9 having a modified electrode structure. Referring to FIG. 10, the barrier ribs of the PDP have the same structure as those of the PDP of FIG. 9, and ring-shaped Y electrodes 106*a* and 106*b* can be arranged above and below a ring-shaped X electrode 107, or two ring-shaped X electrodes can be arranged above and below a ring-shaped Y electrode. When the X electrode 107 and the Y electrodes 106*a* and 106*b* are arranged as shown in FIG. 10, a surface where a discharge occurs can be extended in the height direction of the discharge cell C. To lower the address voltage supplied between the address electrode 103 and the Y electrode 106*b*, the Y electrode 106*b* can be arranged to be close to the address electrode 103, that is, close to the rear substrate 102. Except for the above, the PDP of the present embodiment is the same as the PDP of FIG. 8, and the structures of FIG. 3 through FIG. 6 can be applied to the present embodiment.

The PDP described above can be, together with a driving circuit, employed by a flat panel display, for example, a plasma display, according to an embodiment of the present invention.

A PDP and a flat panel display including the PDP according to the present invention have the following various advantages.

First, the electric field around an address electrode is strengthened, decreasing the address discharge voltage.

Second, an address discharge voltage can be maintained constant.

Third, the aperture ratio and transmission of visible light the front substrate are remarkably improved, and an area where a discharge occurs can be increased. Furthermore, the plasma can be concentrated in the center of a discharge space and the luminous efficiency can be enhanced even when a concentrated Xe gas is used as a discharge gas. Moreover, the response speed to discharge is fast, low-voltage driving is possible, and permanent image retention is completely prevented.

Fourth, an abnormal discharge in a dummy area outside of a display available area can be prevented.

While the present invention has been particularly shown and described with reference to exemplary embodiments thereof, it will be understood by those of ordinary skill in the art that various modifications in form and detail can be made therein without departing from the spirit and scope of the present invention as defined by the following claims.

What is claimed is:

1. A Plasma Display Panel (PDP), comprising:

a front substrate;

a rear substrate disposed parallel to the front substrate;

a plurality of barrier ribs interposed between the front substrate and the rear substrate to define discharge cells together with the front and rear substrates;

a plurality of electrodes enclosing each of the discharge cells;

a fluorescent layer arranged in each of the discharge cells; and a discharge gas in the discharge cells;

wherein a portion of an outermost barrier rib defining an outside edge of an outermost discharge cell is thicker than a remaining portion of the outermost barrier rib; and wherein a portion of the outermost barrier rib facing outside is thicker than a portion of the outermost barrier rib facing inside.

2. The PDP of claim 1, wherein the electrodes comprise a plurality of address electrodes arranged on the rear substrate.

3. The PDP of claim 1, wherein each of the barrier ribs comprises a first barrier rib extending from the front substrate and a second barrier rib extending from the rear substrate.

4. The PDP of claim 3, wherein at least a surface of the first barrier rib is covered with a protective film.

5. A Plasma Display Panel (PDP), comprising:

a front substrate;

a rear substrate disposed parallel to the front substrate;

a plurality of barrier ribs interposed between the front substrate and the rear substrate to define discharge cells together with the front and rear substrates, and including a dielectric;

a plurality of electrodes enclosing each of the discharge cells;

a fluorescent layer arranged in each of the discharge cells; and a discharge gas in the discharge cells;

wherein a dielectric permittivity of a portion of the outermost barrier rib defining an outside edge of an outermost discharge cell is smaller than a dielectric permittivity of a remaining portion of the outermost barrier rib; and wherein a dielectric permittivity of a portion of the outermost barrier rib facing outside is smaller than a dielectric permittivity of a portion of the outermost barrier rib facing inside.

6. The PDP of claim 5, wherein the electrodes include a plurality of discharge electrodes arranged in pairs in the barrier ribs.

7. The PDP of claim 6, wherein a dielectric permittivity of a portion of the outermost barrier rib between the discharge electrodes is smaller than the dielectric permittivity of a remaining portion of the outermost barrier rib.

8. The PDP of claim 5, wherein the electrodes comprise a plurality of address electrodes arranged on the rear substrate.

9. The PDP of claim 5, wherein each of the barrier ribs includes a first barrier rib extending from the front substrate and a second barrier rib extending from the rear substrate.

10. The PDP of claim 9, wherein at least a surface of the first barrier rib is covered with a protective film.

11. A Plasma Display Panel (PDP), comprising:

a front substrate;

a rear substrate disposed parallel to the front substrate;

a plurality of barrier ribs interposed between the front substrate and the rear substrate to define discharge cells together with the front and rear substrates, and including a dielectric;

a plurality of electrodes enclosing each of the discharge cells;

a fluorescent layer formed in each of the discharge cells; and a discharge gas in the discharge cells;

wherein a dummy barrier rib is formed outside of and spaced apart from an outermost barrier rib defining an outside edge of an outermost discharge cell; and wherein the barrier ribs defining an outside edge of an outermost discharge cell are different from the remaining barrier ribs.

12. The PDP of claim 11, wherein a width between the dummy barrier rib and the outermost barrier rib is smaller than a width of each of the discharge cells.

13. The PDP of claim 11, wherein the electrodes comprise a plurality of discharge electrodes arranged in pairs in the barrier ribs.

14. The PDP of claim 11, wherein the electrodes include a plurality of address electrodes arranged on the rear substrate.

15. The PDP of claim 11, wherein each of the barrier ribs includes a first barrier rib extending from the front substrate and a second barrier rib extending from the rear substrate.

16. The PDP of claim 15, wherein at least a surface of the first barrier rib is covered with a protective film.

17. A Plasma Display Panel (PDP), comprising:

a front substrate;

a rear substrate disposed parallel to the front substrate;

a plurality of barrier ribs interposed between the front substrate and the rear substrate to define discharge cells together with the front and rear substrates;

a plurality of electrodes enclosing each of the discharge cells;

a fluorescent layer arranged in each of the discharge cells; and a discharge gas in the discharge cells;

wherein a portion of an outermost barrier rib defining an outside edge of an outermost discharge cell is thicker than a remaining portion of the outermost barrier rib;

wherein the electrodes comprise a plurality of discharge electrodes arranged in pairs in the barrier ribs; and wherein a portion of an outermost barrier rib between the discharge electrodes is thicker than a remaining portion of the outermost barrier rib.

* * * * *